US011858088B2

(12) United States Patent
Moriya et al.

(10) Patent No.: US 11,858,088 B2
(45) Date of Patent: Jan. 2, 2024

(54) POLISHING APPARATUS

(71) Applicant: DISCO CORPORATION, Tokyo (JP)

(72) Inventors: Toshiyuki Moriya, Tokyo (JP); Takamasa Suzuki, Tokyo (JP); Yuki Inoue, Tokyo (JP); Jai Kwang Han, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/655,811

(22) Filed: Mar. 22, 2022

(65) Prior Publication Data

US 2022/0305612 A1 Sep. 29, 2022

(30) Foreign Application Priority Data

Mar. 29, 2021 (JP) ..... 2021-054661

(51) Int. Cl.
*B24B 37/10* (2012.01)
*B24B 53/017* (2012.01)
(Continued)

(52) U.S. Cl.
CPC ..... *B24B 37/107* (2013.01); *B24B 37/30* (2013.01); *B24B 53/017* (2013.01); *B24B 57/02* (2013.01)

(58) Field of Classification Search
None
See application file for complete search history.

(56) References Cited

U.S. PATENT DOCUMENTS 4,750,915 A * 6/1988 Tomita ..... B24D 3/34 51/308
6,573,979 B2 * 6/2003 Yamada ..... G03F 7/70925 355/72
(Continued)

FOREIGN PATENT DOCUMENTS

JP H01205950 A * 8/1989
JP H10166268 A * 6/1998
(Continued)

OTHER PUBLICATIONS

Machine translation of JP 2019/040945 to Hasegawa "HasegawaTranslation" (Year: 2019).*
(Continued)

*Primary Examiner* — Don M Anderson
*Assistant Examiner* — Jonathan R Zaworski
(74) *Attorney, Agent, or Firm* — Greer Burns & Crain Ltd.

(57) ABSTRACT

A polishing apparatus includes a chuck table, a rotation mechanism that rotates the chuck table around a predetermined rotation axis, a polishing unit that has a spindle and in which a polishing pad for polishing the wafer sucked and held by the holding surface is mounted on a lower end part of the spindle, a slurry supply unit, and a cleaning unit that cleans the holding surface. The cleaning unit has a cleaning abrasive stone for removing the slurry that adheres to the holding surface through getting contact with the holding surface and a positioning unit that positions the cleaning abrasive stone to a cleaning position at which the cleaning abrasive stone gets contact with the holding surface and an evacuation position at which the cleaning abrasive stone is separate from the holding surface. Hardness of the cleaning abrasive stone is lower than the hardness of the holding surface.

8 Claims, 4 Drawing Sheets

(51) Int. Cl.
*B24B 57/02* (2006.01)
*B24B 37/30* (2012.01)

(56) References Cited

U.S. PATENT DOCUMENTS

| | | | | |
|---|---|---|---|---|
| 6,652,357 | B1 * | 11/2003 | Williams | B24B 53/017 451/63 |
| 6,776,699 | B2 * | 8/2004 | Amano | B24D 3/28 451/527 |
| 6,780,091 | B2 * | 8/2004 | Mizomoto | B24B 53/017 451/65 |
| 7,238,087 | B1 * | 7/2007 | Kashiwa | B24B 41/005 451/287 |
| 7,306,509 | B2 * | 12/2007 | Hoshino | B24B 37/042 451/28 |
| 7,637,802 | B2 * | 12/2009 | Yasuoka | B24D 3/32 451/41 |
| 7,655,316 | B2 * | 2/2010 | Parkhe | B08B 1/00 428/458 |
| 8,366,514 | B2 * | 2/2013 | Ide | B24B 37/00 451/287 |
| 8,955,530 | B2 * | 2/2015 | Peng | H01L 21/67028 15/210.1 |
| 9,393,669 | B2 * | 7/2016 | Kalenian | B24B 49/04 |
| 11,120,985 | B2 * | 9/2021 | Kodama | B24B 37/27 |
| 11,203,094 | B2 * | 12/2021 | Murachi | B08B 1/002 |
| 11,559,869 | B2 * | 1/2023 | Ando | H01L 21/67219 |
| 2003/0200996 | A1 * | 10/2003 | Hiatt | H01L 21/67046 134/21 |
| 2014/0083468 | A1 * | 3/2014 | Miyazaki | H01L 21/67745 134/82 |
| 2017/0259395 | A1 * | 9/2017 | Kobata | B24B 37/013 |
| 2019/0299354 | A1 * | 10/2019 | Ando | H01L 21/67046 |
| 2019/0314950 | A1 * | 10/2019 | Inoue | B24B 49/04 |
| 2020/0130124 | A1 * | 4/2020 | Tamura | H01L 21/304 |
| 2021/0237228 | A1 * | 8/2021 | Su | H01L 21/304 |

FOREIGN PATENT DOCUMENTS

| | | | | | |
|---|---|---|---|---|---|
| JP | 2002264021 | A | * | 9/2002 | B24D 3/32 |
| JP | 2007184412 | A | * | 7/2007 | |
| JP | 2009111038 | A | * | 5/2009 | |
| JP | 2009160700 | A | * | 7/2009 | |
| JP | 4766678 | B2 | * | 9/2011 | |
| JP | 2011206881 | A | | 10/2011 | |
| JP | 2011206881 | A | * | 10/2011 | |
| JP | 6109681 | B2 | * | 4/2017 | |
| JP | 6141153 | B2 | * | 6/2017 | |
| JP | 2019021859 | A | * | 2/2019 | |
| JP | 2019040945 | A | * | 3/2019 | |
| JP | 2020116665 | A | * | 8/2020 | |
| JP | 6750582 | B2 | * | 9/2020 | |
| JP | 7002874 | B2 | * | 1/2022 | |
| KR | 100214541 | B1 | * | 12/1999 | |
| KR | 20070038365 | A | * | 10/2005 | |
| KR | 20070013489 | A | * | 1/2007 | |
| KR | 20090013407 | A | * | 2/2009 | |
| KR | 20160042061 | A | * | 4/2016 | |
| KR | 20190022364 | A | * | 3/2019 | |
| KR | 20190052138 | A | * | 5/2019 | |
| KR | 20190142522 | A | * | 5/2019 | |
| KR | 20200101977 | A | * | 8/2020 | |
| TW | I405253 | B | * | 8/2013 | |
| WO | WO-2004059714 | A1 | * | 7/2004 | B24D 37/16 |
| WO | WO-2005105373 | A1 | * | 11/2005 | B24B 53/017 |
| WO | WO-2019138881 | A1 | * | 7/2019 | B08B 1/001 |

OTHER PUBLICATIONS

Machine translation of JP 2009/111038 to Takeda et al. "Takeda Translation" (Year: 2009).*

* cited by examiner

POLISHING APPARATUS

BACKGROUND OF THE INVENTION

Field of the Invention

The present invention relates to a polishing apparatus that polishes a wafer.

Description of the Related Art

In a step of manufacturing a semiconductor device from a wafer made of a semiconductor such as silicon, chemical mechanical polishing (CMP) is widely employed when one surface of the wafer is processed substantially flatly (for example, refer to Japanese Patent Laid-open No. 2011-206881). Normally, the chemical mechanical polishing of the wafer is executed by using a polishing apparatus. The polishing apparatus includes a circular plate-shaped chuck table including a holding surface that sucks and holds the wafer. A rotational drive source such as a motor is disposed at a lower part of the chuck table and the chuck table rotates around a predetermined rotation axis when the rotational drive source is operated.

A polishing unit is disposed over the chuck table. The polishing unit includes a spindle. At a lower end part of the spindle, a polishing pad with a circular plate shape is mounted with the interposition of a mount with a circular plate shape. A slurry supply path is formed in the spindle and a through-hole is formed to overlap with the slurry supply path at each central part of the mount and the polishing pad.

When a wafer is polished, first, one surface of the wafer is exposed upward in a state in which the other surface side of the wafer is sucked and held by the chuck table. Then, the chuck table and the spindle are rotated in a predetermined direction. In addition, the polishing pad is brought into contact with the one surface of the wafer while slurry is supplied to the polishing pad. The slurry supplied to the wafer reaches an outer circumferential part of the holding surface due to a centrifugal force.

Due to adherence of the slurry to the outer circumferential part of the holding surface, unevenness in a height is caused in the outer circumferential part of the holding surface. This causes a problem that, when the next wafer is polished, a flatness in the outer circumferential part of the wafer lowers. The slurry that adheres to the outer circumferential part of the holding surface is difficult to be removed by cleaning with cleaning water atomized by using compressed air (generally-called two-fluid cleaning). Therefore, it is conceivable that the slurry is removed by using a leveling stone formed of alumina or the like.

However, normally, the leveling stone has hardness equal to or higher than that of the holding surface. Thus, using the leveling stone causes not only removal of the slurry but also polishing of the holding surface. Therefore, there is a problem that the evenness of the height of the holding surface lowers.

SUMMARY OF THE INVENTION

The present invention is made in view of such a problem and intends to remove slurry that adheres to the outer circumferential part of a holding surface while suppressing lowering of evenness of the height of the holding surface.

In accordance with an aspect of the present invention, there is provided a polishing apparatus including a chuck table having a holding surface capable of sucking and holding a wafer, a rotation mechanism that rotates the chuck table around a predetermined rotation axis, a polishing unit that has a spindle and in which a polishing pad for polishing the wafer sucked and held by the holding surface is mounted on a lower end part of the spindle, a slurry supply unit that supplies slurry to at least one of the wafer sucked and held by the holding surface and the polishing pad, and a cleaning unit that cleans the holding surface. The cleaning unit has a cleaning abrasive stone for removing the slurry that adheres to the holding surface through getting contact with the holding surface and a positioning unit that positions the cleaning abrasive stone to a cleaning position at which the cleaning abrasive stone gets contact with the holding surface and an evacuation position at which the cleaning abrasive stone is separate from the holding surface. The hardness of the cleaning abrasive stone is lower than the hardness of the holding surface.

Preferably, the positioning unit includes an elastic component for pressing the cleaning abrasive stone against the holding surface. Furthermore, preferably, the positioning unit positions the cleaning abrasive stone to the cleaning position and brings the cleaning abrasive stone into contact with part of an outer circumferential part of the holding surface at the time of cleaning of the holding surface.

Preferably, the holding surface is composed of a ceramic and the hardness of the cleaning abrasive stone is equal to or lower than 680 HV in Vickers hardness. Furthermore, preferably, the cleaning abrasive stone is a polyvinyl alcohol (PVA) abrasive stone having abrasive grains and a binder that fixes the abrasive grains. Moreover, preferably, the cleaning abrasive stone includes the abrasive grains made of cerium oxide.

The polishing apparatus according to the aspect of the present invention includes the cleaning unit. The cleaning unit has the cleaning abrasive stone having hardness lower than that of the holding surface and the positioning unit that positions the cleaning abrasive stone to the cleaning position and the evacuation position. When the chuck table is rotated in the state in which the cleaning abrasive stone is brought into contact with the outer circumferential part of the holding surface, the slurry that adheres to the outer circumferential part of the holding surface can be removed by the cleaning abrasive stone. In addition, because the hardness of the cleaning abrasive stone is lower than that of the holding surface, the cleaning abrasive stone can remove the slurry almost without polishing the holding surface itself. Therefore, lowering of the evenness of the height of the holding surface can be suppressed in comparison with the case of polishing the holding surface by a polishing tool such as a leveling stone.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
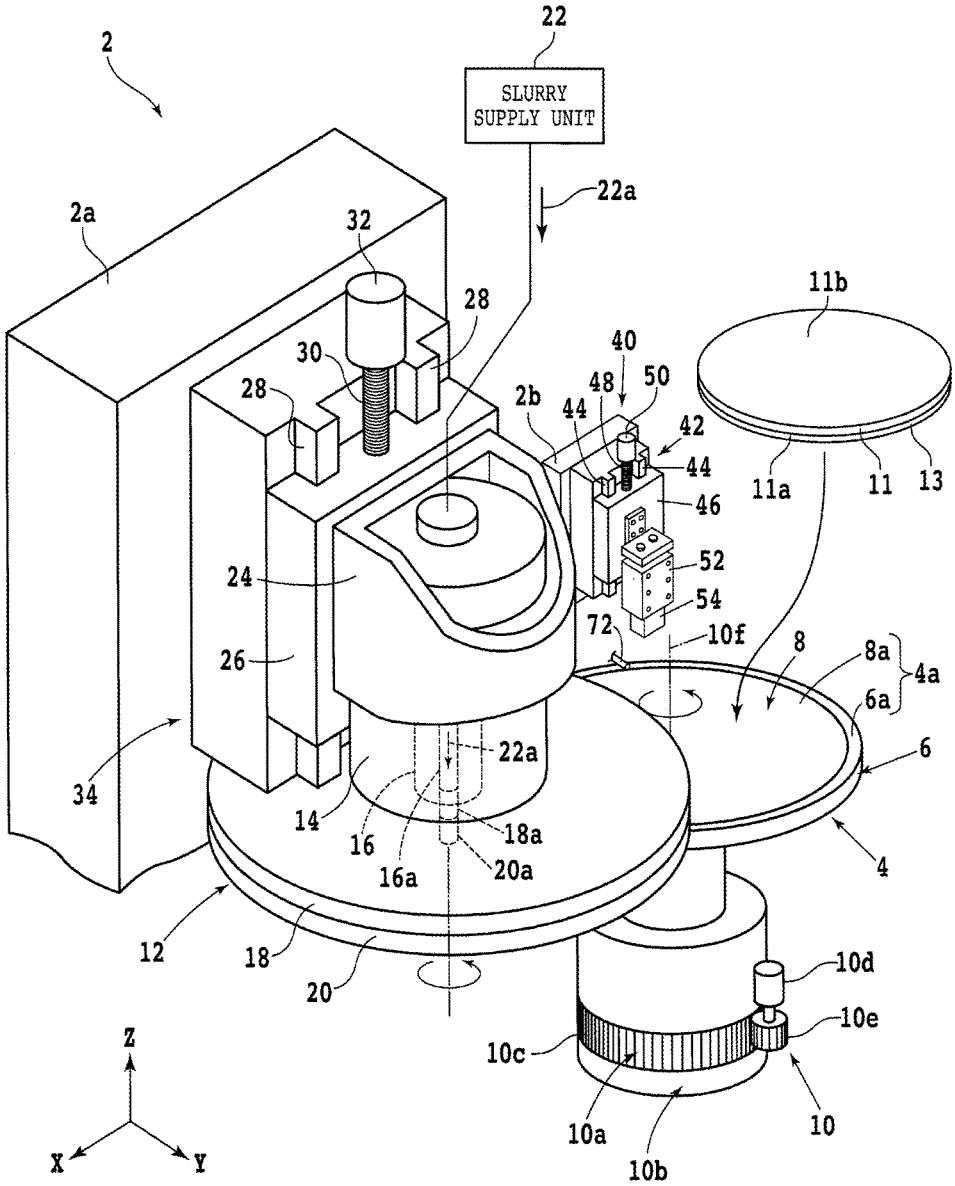
FIG. 1 is a perspective view of a major part of a polishing apparatus.

An embodiment according to the aspect of the present invention will be described with reference to the accompanying drawings. FIG. 1 is a perspective view of a major part of a polishing apparatus 2. An X-axis direction, a Y-axis direction, and a Z-axis direction each illustrated in FIG. 1 are orthogonal to each other. For example, the Z-axis direction is a vertical direction and the X-Y plane is a horizontal plane. The polishing apparatus 2 of the present embodiment is part of one piece of a processing apparatus (polishing-and-grinding apparatus) including a rough grinding apparatus and a finish grinding apparatus. However, the polishing apparatus 2 may be a processing apparatus that executes polishing without executing grinding.

The polishing apparatus 2 has a chuck table 4 with a circular plate shape. The chuck table 4 has a circular plate-shaped frame body 6 formed of a non-porous ceramic. The frame body 6 in the present embodiment is formed of non-porous alumina and has Vickers hardness of 1597 HV. A recess part (not illustrated) with a circular plate shape is formed in the frame body 6 and a circular plate-shaped porous plate 8 formed of a porous ceramic is fixed to this recess part. The porous plate 8 in the present embodiment is formed of porous alumina and has Vickers hardness of 681 HV.

An upper surface 8*a* of the porous plate 8 in the present embodiment has a protrusion shape in which the central part slightly protrudes in comparison with the outer circumferential part. An upper surface 6*a* of the frame body 6 and the upper surface 8*a* of the porous plate 8 are substantially flush with each other and configure a holding surface 4*a*. When the polishing apparatus 2 is a processing apparatus that executes polishing without executing grinding, the upper surface 8*a* of the porous plate 8 may be substantially flat. A predetermined flow path is formed in the frame body 6. A suction source (not illustrated) such as an ejector is connected to one end of the predetermined flow path and the other end of the predetermined flow path is exposed to the recess part. A negative pressure generated by the suction source is transmitted to the upper surface 8*a* of the porous plate 8 through the predetermined flow path. A wafer 11 disposed on the holding surface 4*a* is sucked and held by the holding surface 4*a* by using this negative pressure.

The wafer 11 is formed of silicon (Si), for example. However, there is no limit on a material, a shape, a structure, a size, and so forth of the wafer 11. For example, the wafer 11 may be formed of a semiconductor material or the like other than silicon, composed of gallium nitride (GaN), silicon carbide (SiC), or the like. A protective tape 13 that has substantially the same diameter as the wafer 11 and is made of a resin is stuck to a front surface 11*a* of the wafer 11 in order to reduce damage to the side of the front surface 11*a*.

A ring-shaped rotating base 10*a* is fixed to the lower part of the chuck table 4. At the upper part of the rotating base 10*a*, plural movable components (not illustrated) each composed of an air cylinder, a movable shaft of a screw type, and so forth are disposed along the circumferential direction of the rotating base 10*a*. The plural movable components each support the chuck table 4 and the tilt of the chuck table 4 is adjusted through extension and retraction of the movable components. For example, the tilt of the chuck table 4 is adjusted to cause part of the holding surface 4*a* to become substantially horizontal to the X-Y plane. The part of the holding surface 4*a* that has become substantially horizontal to the X-Y plane is covered by a polishing pad 20 to be described later.

The rotating base 10*a* is rotatably supported by a fixed base 10*b*. A driven gear 10*c* is formed in the outer circumferential side surface of the rotating base 10*a* and a drive gear 10*e* coupled to a motor 10*d* meshes with the driven gear 10*c*. When the drive gear 10*e* is rotated, the chuck table 4 rotates around a predetermined rotation axis 10*f* at approximately 10 rpm to 300 rpm. The rotating base 10*a*, the fixed base 10*b*, the driven gear 10*c*, the motor 10*d*, the drive gear 10*e*, and so forth configure a rotation mechanism 10 that rotates the chuck table 4.

A polishing unit 12 is disposed over the chuck table 4. The polishing unit 12 has a spindle housing 14 with a circular cylindrical shape. Part of a spindle 16 with a circular column shape is rotatably housed in the spindle housing 14. The spindle 16 is disposed along the Z-axis direction and a rotational drive source (not illustrated) such as a motor is disposed at the upper end part of the spindle 16. The lower end part of the spindle 16 protrudes downward relative to the spindle housing 14.

At the upper end part of the spindle 16, the polishing pad 20 with a circular plate shape is mounted with the interposition of a mount 18 with a circular plate shape. The polishing pad 20 includes a base part with a circular plate shape. A pad part that gets contact with the wafer 11 is fixed to one surface of the base part. The pad part in the present embodiment does not have fixed abrasive grains and is formed of a predetermined material. The predetermined material is, for example, a rigid foam material such as rigid polyurethane foam or nonwoven fabric obtained by impregnating nonwoven fabric made of polyester with urethane.

The mount 18 and the polishing pad 20 have substantially the same diameter and through-holes 18*a* and 20*a* are formed therein in such a manner as to penetrate a center of each circle. A flow path 16*a* of slurry 22*a* formed in the spindle 16 is connected to the respective through-holes 18*a* and 20*a*. The slurry 22*a* is, for example, an alkaline aqueous solution containing abrasive grains made of silica (silicon oxide, $SiO_2$). However, the material of the abrasive grains may be green carbon (GC), diamond, alumina (aluminum oxide, $Al_2O_3$), ceria (cerium oxide, $CeO_2$), cubic boron nitride (cBN), or silicon carbide (SiC). Furthermore, an acidic aqueous solution is used instead of the alkaline aqueous solution in some cases. The slurry 22*a* is supplied from a slurry supply unit 22 to the through-holes 18*a* and 20*a* via the flow path 16*a*. The slurry supply unit 22 includes a storage tank (not illustrated) in which the slurry 22*a* is stored and a pump (not illustrated) for supplying the slurry 22*a* from the storage tank to the flow path 16*a*.

A holding component 24 is fixed to the outer circumferential part of the spindle housing 14. The holding component 24 is fixed to a Z-axis moving plate 26. The Z-axis moving plate 26 is slidably attached to a pair of guide rails 28 disposed substantially in parallel to the Z-axis direction. A ball screw 30 is disposed substantially in parallel to the Z-axis direction between the pair of guide rails 28. The ball screw 30 is rotatably coupled to a nut part (not illustrated)

disposed on the Z-axis moving plate 26. A stepping motor 32 is coupled to the upper end part of the ball screw 30.

The ball screw 30 is rotated by the stepping motor 32, and the Z-axis moving plate 26 moves along the Z-axis direction. The holding component 24, the Z-axis moving plate 26, the pair of guide rails 28, the ball screw 30, the stepping motor 32, and so forth configure a Z-axis movement unit 34 that adjusts a height position of the polishing unit 12. The Z-axis movement unit 34 is fixed to a moving block 2*a* that can move in the X-axis direction by an X-axis movement mechanism (not illustrated) of a ball screw system. On one side in the X-axis direction relative to the moving block 2*a*, a support column 2*b* fixed to a base (not illustrated) is disposed.

A cleaning unit 40 for cleaning the holding surface 4*a* is disposed on the support column 2*b*. The cleaning unit 40 is disposed over the chuck table 4. The cleaning unit 40 has a positioning unit 42. The positioning unit 42 has a pair of guide rails 44 whose position is fixed relative to the support column 2*b*. A Z-axis moving plate 46 is slidably attached to the pair of guide rails 44.

A nut part (not illustrated) is disposed on the Z-axis moving plate 46. To this nut part, a ball screw 48 disposed substantially in parallel to the Z-axis direction between the pair of guide rails 44 is rotatably coupled. A stepping motor 50 is coupled to the upper end part of the ball screw 48. When the ball screw 48 is rotated by the stepping motor 50, the Z-axis moving plate 46 moves along the Z-axis direction. A cleaning abrasive stone holder 52 is fixed to the side of the front surface of the Z-axis moving plate 46 (one side in the Y-axis direction).

To the cleaning abrasive stone holder 52, a cleaning abrasive stone 54 that has hardness lower than that of the holding surface 4*a* and has a rectangular parallelepiped shape (for example, vertical length 24 mm, horizontal length 46 mm, height 28 mm) is fixed. The cleaning abrasive stone 54 has hardness of 680 HV or lower in Vickers hardness, for example. The cleaning abrasive stone 54 in the present embodiment is a PVA abrasive stone in which abrasive grains (grit number that indicates the grain size of the abrasive grains is #3000) made of cerium oxide are fixed by using PVA as a binder. The PVA abrasive stone has elasticity attributed to pores continuously formed in the binder and has Vickers hardness of 34 HV, for example. However, the cleaning abrasive stone 54 is not limited only to the PVA abrasive stone. The cleaning abrasive stone 54 may be a rubber abrasive stone in which abrasive grains of ceria, silica, alumina, or the like are fixed by vulcanized rubber as long as the Vickers hardness is equal to or lower than 680 HV.

When the cleaning abrasive stone 54 that is sufficiently soft compared with the holding surface 4*a* is used and the holding surface 4*a* is brought into contact with the cleaning abrasive stone 54 as above, the slurry 22*a* that adheres to the outer circumferential part of the holding surface 4*a* can be removed without changing the evenness of the height of the holding surface 4*a*. However, although the Vickers hardness is equal to or lower than 680 HV, it is impossible to remove the slurry 22*a* with a sponge such as an urethane sponge commercially available for home use because the sponge is too soft. Therefore, the Vickers hardness of the cleaning abrasive stone 54 is set to preferably 10 HV or higher, more preferably 20 HV or higher, and further preferably 30 HV or higher. Furthermore, even when the Vickers hardness is equal to or lower than 680 HV, the Vickers hardness of the cleaning abrasive stone 54 is set to preferably 600 HV or lower, more preferably 300 HV or lower, and further preferably 100 HV or lower in order to reduce the amount of polishing of the holding surface 4*a* as much as possible.

Figure 2:
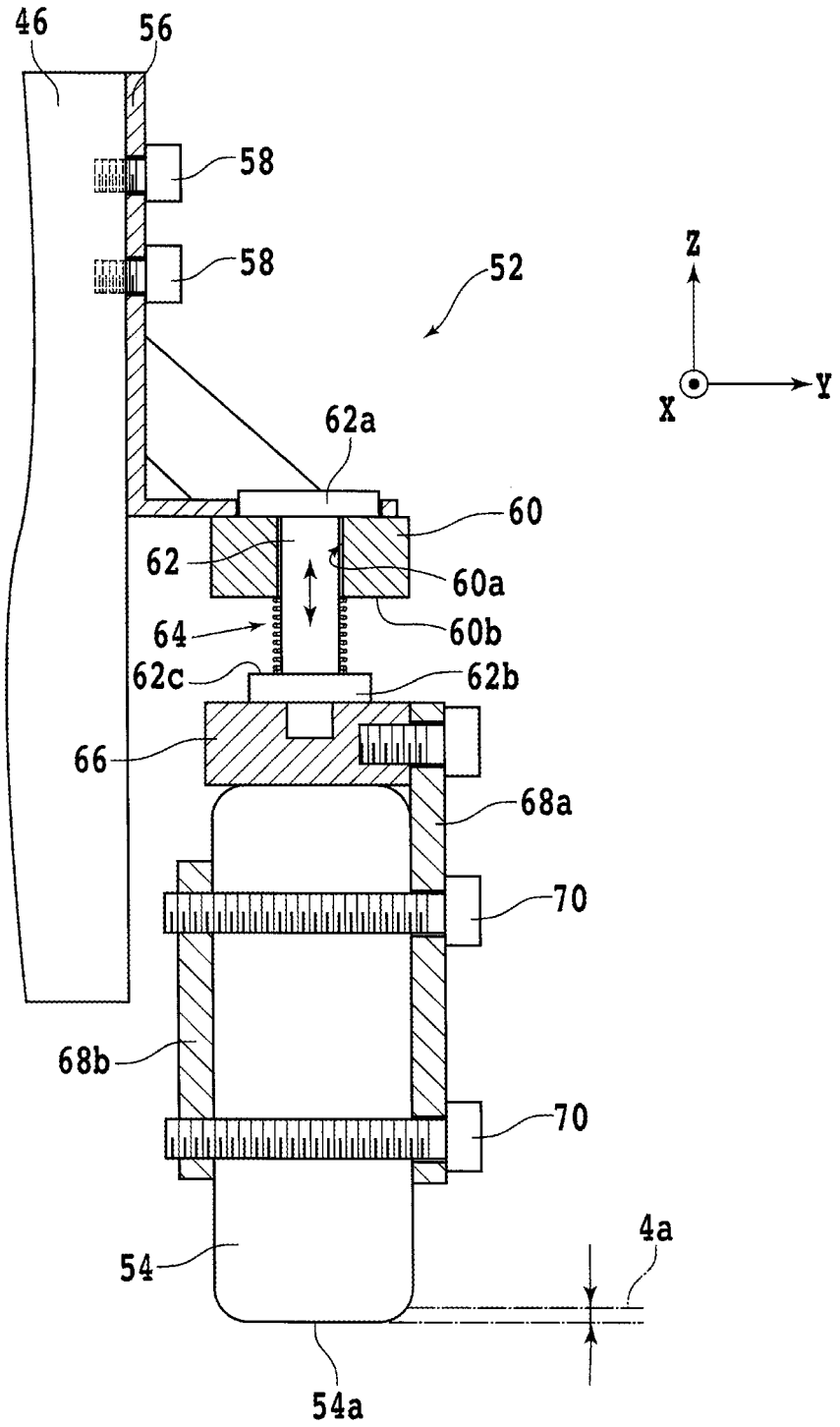
FIG. 2 is a partially sectional side view of a cleaning abrasive stone holder.

Here, with reference to FIG. 2, a structure of the cleaning abrasive stone holder 52 will be described in more detail. FIG. 2 is a partially sectional side view of the cleaning abrasive stone holder 52. The cleaning abrasive stone holder 52 has a bracket 56 with an L-shape in side view. The bracket 56 has a first straight line part fixed to the front surface side of the Z-axis moving plate 46 by bolts 58. At one end part of the first straight line part, a second straight line part is disposed in such a manner as to be orthogonal to the first straight line part. An upper plate 60 is fixed by a bolt (not illustrated) to the lower surface of the second straight line part in the bracket 56 fixed to the Z-axis moving plate 46.

A through-hole 60*a* is formed in the upper plate 60 and a shaft part 62 with a circular column shape is slidably inserted in the through-hole 60*a*. A circular plate-shaped head part 62*a* having a larger diameter than the through-hole 60*a* is fixed to the upper end part of the shaft part 62. The head part 62*a* is disposed on the upper side relative to the upper plate 60 and therefore the shaft part 62 is supported by the upper plate 60. A circular plate-shaped support part 62*b* having a larger diameter than the shaft part 62 is fixed to the vicinity of the lower end part of the shaft part 62.

Between an upper surface 62*c* of the support part 62*b* and a lower surface 60*b* of the upper plate 60, a helical compression spring (elastic component) 64 made of a metal is disposed around the outer circumferential part of the shaft part 62. Although the helical compression spring 64 is used in the present embodiment, a spring, rubber, or the like in another form may be used as long as a restoring force can be exerted. A lower plate 66 is fixed to the lower surface of the support part 62*b*. The upper end part of a first plate part 68*a* is fixed to one side of the lower plate 66 in the Y-axis direction. Furthermore, on the other side in the Y-axis direction, a second plate part 68*b* is fixed to the first plate part 68*a* with the interposition of plural bolts 70.

The first plate part 68*a* and the second plate part 68*b* clamp the above-described cleaning abrasive stone 54 in the Y-axis direction. The cleaning abrasive stone 54 is fixed by the lower plate 66, the first plate part 68*a*, and the second plate part 68*b* in such a manner that the upper part thereof is in contact with the lower surface of the lower plate 66 and the lower part thereof protrudes downward relative to the first plate part 68*a* and the second plate part 68*b*. The position of the cleaning abrasive stone 54 in the X-Y plane direction corresponds to one place on the outer circumferential part of the holding surface 4*a*. By moving the cleaning abrasive stone 54 along the Z-axis direction by the positioning unit 42, the cleaning abrasive stone 54 is positioned to a cleaning position (see FIG. 3) at which the cleaning abrasive stone 54 gets contact with the holding surface 4*a* and an evacuation position (see FIG. 1) at which the cleaning abrasive stone 54 is separate from the holding surface 4*a*. As illustrated in FIG. 1, a nozzle 72 that supplies cleaning water such as purified water to the contact region between the cleaning abrasive stone 54 and the holding surface 4*a* is disposed under the cleaning abrasive stone holder 52. A cleaning water supply unit (not illustrated) having a tank, a pump, and so forth is connected to the nozzle 72 through a predetermined flow path.

Operation of the cleaning unit 40 including the nozzle 72 is controlled by a control unit (not illustrated). The control unit also controls operation of the rotation mechanism 10, the rotational drive source disposed in the spindle housing 14, the slurry supply unit 22, the Z-axis movement unit 34, and so forth. The control unit is configured by a computer including a processor (processing device) typified by a central processing unit (CPU), a main storing device such as a dynamic random access memory (DRAM), and an auxiliary storing device such as a flash memory, for example. Software including a predetermined program is stored in the auxiliary storing device. Functions of the control unit are implemented by causing the processing device and so forth to operate according to this software.

Next, with reference to FIG. 2 and FIG. 3, polishing of the wafer 11, removal of the slurry 22*a* that adheres to the outer circumferential part of the holding surface 4*a*, and so forth will be described. First, in the state in which the polishing unit 12 has been evacuated from directly above the holding surface 4*a* by the moving block 2*a* and the cleaning abrasive stone 54 has been moved to the evacuation position, the wafer 11 is carried in to the holding surface 4*a* by a conveying unit that is not illustrated in the diagram, with a back surface 11*b* of the wafer 11 exposed upward (carrying-in step). After the carrying-in step, the side of the front surface 11*a* of the wafer 11 is sucked and held by the holding surface 4*a* (holding step). After the holding step, the polishing unit 12 is moved by the moving block 2*a* to cause part of the polishing unit 12 to cover the holding surface 4*a*.

Thereafter, while the chuck table 4 and the polishing pad 20 are rotated in a predetermined direction and the polishing unit 12 is lowered at a predetermined polishing feed rate, the slurry 22*a* is supplied from the slurry supply unit 22 to at least one of the wafer 11 and the polishing pad 20. In this manner, the back surface 11*b* is polished by the polishing pad 20 while the wafer 11 is pressed with a predetermined pressing force (polishing step). The wafer 11 thinned to a predetermined thickness by the polishing step is carried out from the holding surface 4*a* by the conveying unit that is not illustrated in the diagram (carrying-out step).

Figure 3:
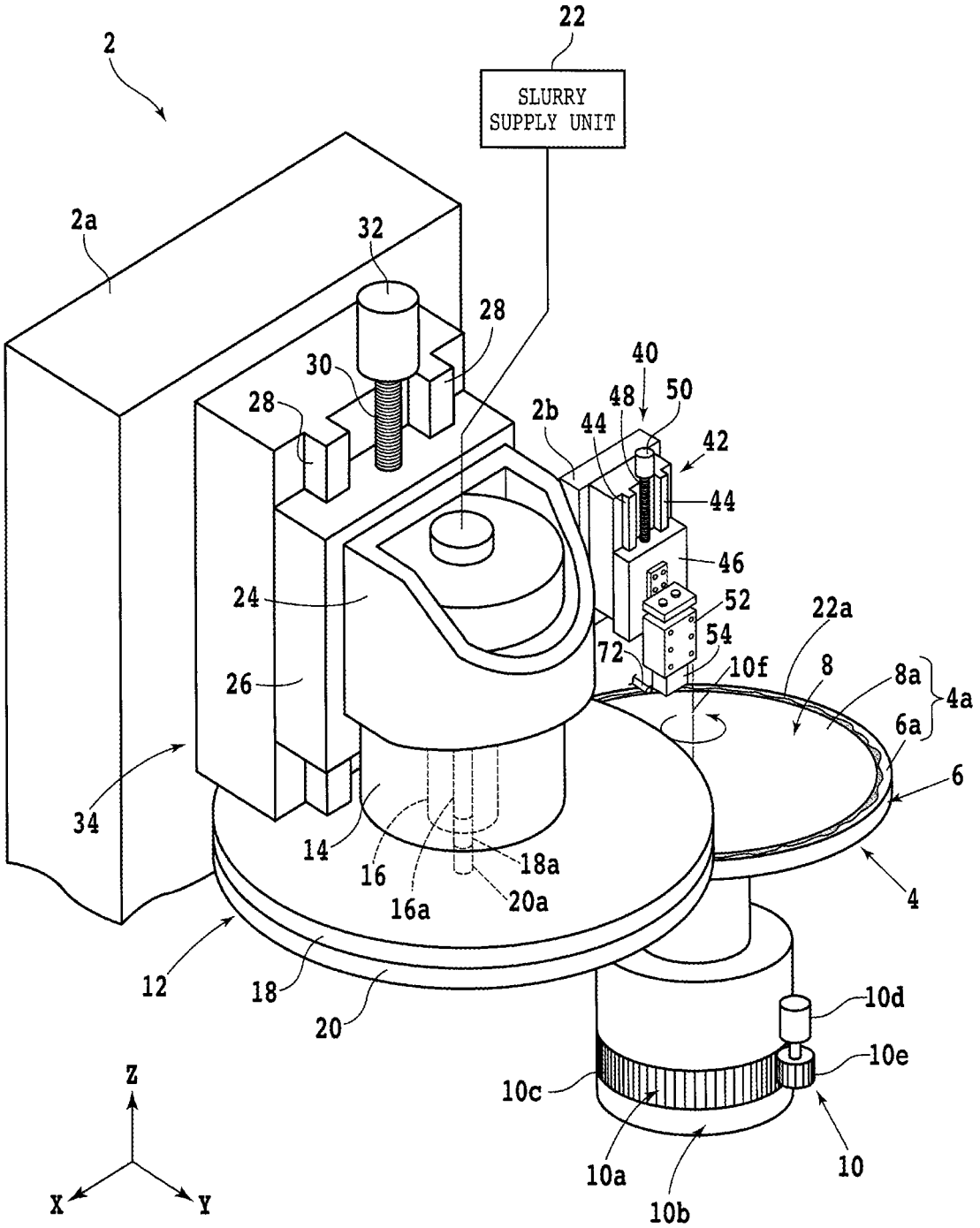
FIG. 3 is a diagram illustrating a state in which a cleaning abrasive stone is brought into contact with a holding surface.

After the carrying-out step, due to movement of the slurry 22*a* supplied in the polishing step on the basis of a centrifugal force and so forth, the slurry 22*a* adheres to the outer circumferential part of the holding surface 4*a* (see FIG. 3). The slurry 22*a* mainly adheres to the upper surface 6*a* of the frame body 6 that is not covered by the wafer 11. However, the slurry 22*a* adheres to the outer circumferential part of the upper surface 8*a* due to the negative pressure generated at the upper surface 8*a* of the porous plate 8, and so forth, in some cases. In the present embodiment, the slurry 22*a* that adheres to the outer circumferential part of the holding surface 4*a* is removed by using the cleaning unit 40 (cleaning step). At the time of cleaning, the chuck table 4 is rotated at a predetermined speed while the cleaning water is supplied from the nozzle 72 to the outer circumferential part of the holding surface 4*a* at a predetermined flow rate (for example, 2 (1/min)).

Subsequently, the cleaning abrasive stone 54 is lowered by the positioning unit 42 and is moved to the cleaning position. In this manner, a lower surface 54*a* gets contact with part of the upper surface 6*a* of the frame body 6 and part of the upper surface 8*a* of the porous plate 8 (see FIG. 3). FIG. 3 is a diagram illustrating the state in which the cleaning abrasive stone 54 is brought into contact with the holding surface 4*a*. At this time, the position of the cleaning abrasive stone holder 52 in the Z-axis direction is adjusted to cause the lower surface 54*a* (see FIG. 2) of the cleaning abrasive stone 54 to become lower than the holding surface 4*a* by, for example, 6 mm. In this manner, the cleaning abrasive stone 54 is pressed against the holding surface 4*a* with a certain pressure by a restoring force from the helical compression spring 64.

In the cleaning step, the slurry 22*a* is scraped off by the cleaning abrasive stone 54. In addition, the slurry 22*a* scraped off is caused to drop to the outside of the holding surface 4*a* by using the cleaning water that flows outward in the radial direction of the holding surface 4*a* due to the centrifugal force. In this manner, the slurry 22*a* that adheres to the outer circumferential part of the holding surface 4*a* can be substantially all removed. In the present embodiment, because the hardness of the cleaning abrasive stone 54 is lower than that of the holding surface 4*a*, the cleaning abrasive stone 54 can remove the slurry 22*a* without changing the evenness of the height of the holding surface 4*a*. Therefore, lowering of the evenness of the height of the holding surface 4*a* can be suppressed in comparison with the case of polishing the holding surface 4*a* by a polishing tool such as a leveling stone. After the cleaning step, a return to the carrying-in step is made and the second wafer 11 is polished. In this manner, the polishing of the wafer 11 and the cleaning of the holding surface 4*a* are alternately executed.

Figure 4A:
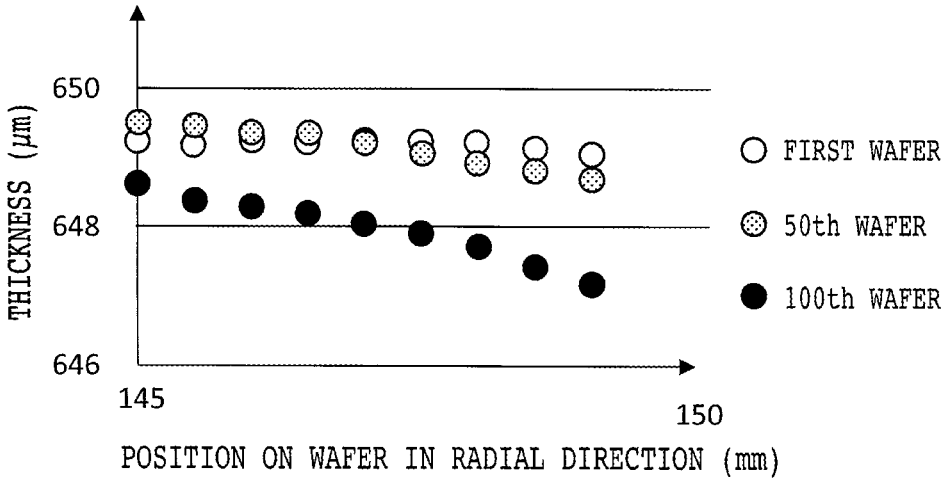
FIG. 4A is a graph illustrating a thickness of an outer circumferential part of a wafer in the case in which two-fluid cleaning has been executed for the outer circumferential part of the holding surface in a cleaning step and plural wafers have been polished.

Next, an experiment result in the case in which plural wafers 11 have been polished one by one by the polishing apparatus 2 will be described. FIG. 4A is a graph illustrating the thickness of the outer circumferential part of the wafer 11 in the case in which two-fluid cleaning has been executed for the outer circumferential part of the holding surface 4*a* in the cleaning step (that is, the holding surface 4*a* has been cleaned by cleaning water atomized by using compressed air) and the plural wafers 11 have been polished. In contrast, FIG. 4B is a graph illustrating the thickness of the outer circumferential part of the wafer 11 in the case in which the outer circumferential part of the holding surface 4*a* has been cleaned by using the above-described cleaning unit 40 in the cleaning step and the plural wafers 11 have been polished.

Figure 4B:
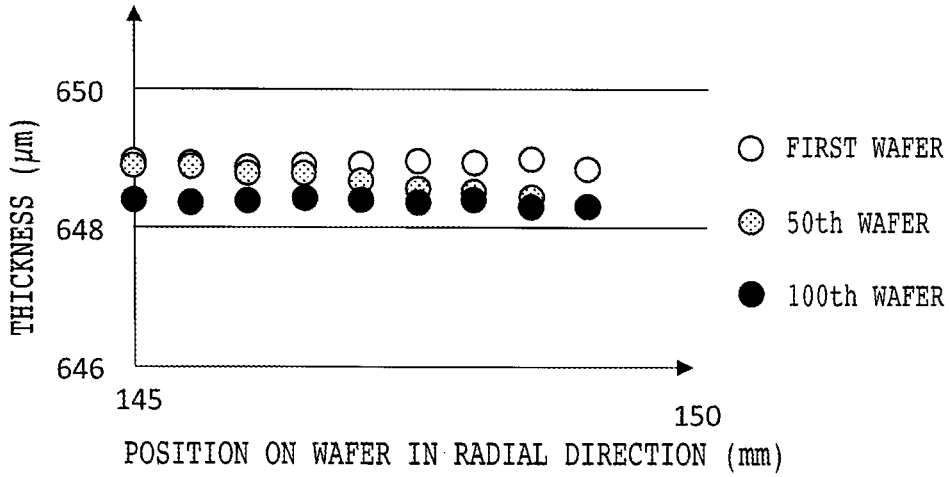
FIG. 4B is a graph illustrating the thickness of the outer circumferential part of the wafer in the case in which the outer circumferential part of the holding surface has been cleaned by using a cleaning unit in the cleaning step, and plural wafers have been polished.

In FIG. 4A and FIG. 4B, an abscissa axis indicates a position (mm) on the wafer 11 in a radial direction and an ordinate axis indicates a thickness (μm) of the wafer 11. Furthermore, white circles indicate the first wafer 11, and circles including dots indicate the 50th wafer 11, and black circles indicate the 100th wafer 11.

In the experiment illustrated in FIG. 4A, after the first wafer 11 has been polished, the two-fluid cleaning has been executed for the outer circumferential part of the holding surface 4*a* and subsequently the second wafer 11 has been polished. Thereafter, the two-fluid cleaning has been executed for the outer circumferential part of the holding surface 4*a* and the third wafer 11 has been polished. In this manner, the hundred wafers 11 have been polished.

Furthermore, in the experiment illustrated in FIG. 4B, after the first wafer 11 has been polished, the outer circumferential part of the holding surface 4*a* has been cleaned with the cleaning abrasive stone 54. Subsequently, the second wafer 11 has been polished and thereafter the outer circumferential part of the holding surface 4*a* has been cleaned with the cleaning abrasive stone 54. In this manner, the hundred wafers 11 have been polished.

As illustrated in FIG. 4A, in the case of executing the two-fluid cleaning for the outer circumferential part of the holding surface 4*a*, the slurry 22*a* that adhered to the outer circumferential part of the holding surface 4*a* has been not sufficiently removed. Therefore, the outer circumferential part of the wafer 11 has been raised by the slurry 22*a* that remained. Due to this, the amount of polishing of the outer circumferential part of the wafer 11 became large compared with the amount of polishing of the central part. Therefore, the outer circumferential part of the wafer 11 became thin compared with the central part of the wafer 11. In particular, as is apparent in the 100th wafer 11, the flatness of the wafer 11 deteriorated at the outer circumferential part of the wafer 11.

In contrast, as illustrated in FIG. 4B, in the case of executing the cleaning step, the flatness of the wafer 11 did not deteriorate even in the 100th wafer 11. As above, it has become clear that lowering of the evenness of the height of the holding surface 4*a* can be suppressed by removing the slurry 22*a* that adheres to the outer circumferential part of the holding surface 4*a* by using the cleaning abrasive stone 54.

The present invention is not limited to the details of the above described preferred embodiment. The scope of the invention is defined by the appended claims and all changes and modifications as fall within the equivalence of the scope of the claims are therefore to be embraced by the invention. Structures, methods, and so forth according to the above-described embodiment can be carried out with appropriate changes without departing from the range of the object of the present invention.

What is claimed is:

1. A polishing apparatus comprising:

a chuck table having a holding surface capable of sucking and holding a wafer;

a rotation mechanism that rotates the chuck table around a predetermined rotation axis;

a polishing unit that has a spindle and in which a polishing pad for polishing the wafer sucked and held by the holding surface is mounted on a lower end part of the spindle;

a slurry supply unit that supplies slurry to at least one of the wafer sucked and held by the holding surface and the polishing pad; and a cleaning unit that cleans the holding surface, wherein: the cleaning unit has:

a cleaning abrasive stone configured to contact the holding surface and remove slurry that has adhered to the holding surface, a positioning unit that positions the cleaning abrasive stone to a cleaning position at which the cleaning abrasive stone contacts the holding surface and an evacuation position at which the cleaning abrasive stone is separate from the holding surface, wherein the positioning unit includes an elastic component, and a cleaning abrasive stone holder secured to the positioning unit, when the cleaning abrasive stone is held in place within the cleaning abrasive stone holder by at least one fastener which secures first and second plates disposed on opposite sides of the cleaning abrasive stone, hardness of the cleaning abrasive stone is lower than hardness of the holding surface, the elastic component comprises a compression spring, the cleaning abrasive stone remains stationary in a X-Y plane when the cleaning unit is removing the slurry that has adhered to the holding surface, and the X-Y plane is vertical to a Z-axis direction where the spindle is disposed along the Z-axis direction.

2. The polishing apparatus according to claim 1, wherein:

the elastic component is configured for pressing the cleaning abrasive stone against the holding surface.

3. The polishing apparatus according to claim 1, wherein:

the positioning unit positions the cleaning abrasive stone to the cleaning position and brings the cleaning abrasive stone into contact with part of an outer circumferential part of the holding surface at a time of cleaning of the holding surface.

4. The polishing apparatus according to claim 1, wherein:

the holding surface is composed of ceramic, and the hardness of the cleaning abrasive stone is equal to or lower than 680 HV in Vickers hardness.

5. The polishing apparatus according to claim 1, wherein:

the cleaning abrasive stone is a polyvinyl alcohol abrasive stone having abrasive grains and a binder that fixes the abrasive grains.

6. The polishing apparatus according to claim 5, wherein:

the cleaning abrasive stone includes abrasive grains made of cerium oxide.

7. The polishing apparatus according to claim 1, wherein the cleaning abrasive stone has a rectangular parallelepiped shape.

8. The polishing apparatus according to claim 1, wherein the cleaning abrasive stone holder further comprises:

a bracket secured to the positioning unit;

an upper plate having a through-hole fixed to the bracket; and a shaft with an enlarged head disposed within the through-hole, wherein the elastic component is disposed around an outer circumferential part of the shaft.

* * * * *